US008552351B2

(12) United States Patent
Geswender et al.

(10) Patent No.: US 8,552,351 B2
(45) Date of Patent: Oct. 8, 2013

(54) PROJECTILE WITH DEPLOYABLE CONTROL SURFACES

(75) Inventors: Chris E. Geswender, Green Valley, AZ (US); Matthew A. Zamora, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1042 days.

(21) Appl. No.: 12/464,345

(22) Filed: May 12, 2009

(65) Prior Publication Data

US 2010/0288870 A1 Nov. 18, 2010

(51) Int. Cl.
*F42B 15/01* (2006.01)

(52) U.S. Cl.
USPC ..... 244/3.27

(58) Field of Classification Search
USPC ..... 244/3.1, 3.23, 3.27, 3.28, 3.29
See application file for complete search history.

(56) References Cited

U.S. PATENT DOCUMENTS

| | | | | |
|---|---|---|---|---|
| 1,166,879 | A * | 1/1916 | Alard | 244/3.29 |
| 4,607,810 | A * | 8/1986 | Frazer | 244/3.29 |
| 4,964,593 | A * | 10/1990 | Kranz | 244/3.24 |
| 5,368,255 | A * | 11/1994 | August | 244/3.28 |
| 7,163,176 | B1 | 1/2007 | Geswender et al. | |
| 7,354,017 | B2 | 4/2008 | Morris et al. | |
| 7,412,930 | B2 | 8/2008 | Smith et al. | |
| 2010/0282895 | A1 * | 11/2010 | Geswender | 244/3.29 |

* cited by examiner

*Primary Examiner* — Rob Swiatek
*Assistant Examiner* — Valentina Xavier
(74) *Attorney, Agent, or Firm* — Renner, Otto, Boisselle & Sklar, LLP

(57) ABSTRACT

A projectile has a fuze kit that includes deployable canards. The canards are ends of a strip of material. The strip of material is initially in an angled recess of a collar of the fuze kit, with the angled recess angled relative to a longitudinal axis of the projectile, defining a plane that is not perpendicular to the longitudinal axis. At some point in flight of the projectile, for example during mid-course of the projectile flight after a ballistic phase of the projectile flight, the canards are deployed by releasing the ends of the strip. This causes the ends of the strip to pull away from the longitudinal axis of the projectile, out of the recess, into the airstream around the projectile. Resilient forces in the strip may cause the ends to be moved out of the recess when the ends are released.

22 Claims, 4 Drawing Sheets

PROJECTILE WITH DEPLOYABLE CONTROL SURFACES

BACKGROUND OF THE INVENTION

1. Technical Field of the Invention

The invention is in the general field of projectiles with deployable control surfaces.

2. Description of the Related Art

Prior deployment systems of control surfaces, such as canards or fins, for projectiles of missiles, have sometimes relied upon centrifugal forces for deployment. There is general room for improvement in the field of deployment of control surfaces for projectiles and missiles.

SUMMARY OF THE INVENTION

According to an aspect of the invention, a projectile includes: a collar having an angled recess that is angled relative to a longitudinal axis of the projectile; and a canard strip. Ends of the canard strip may be selectively moved from the angled recess, in a stowed configuration, to a deployed configuration in which the ends of the canard strip are outside of the angled recess, to act as canards.

According to another aspect of the invention, a fuze kit includes: a collar having an angled recess that is angled relative to a longitudinal axis of the projectile; and a canard strip. Ends of the canard strip may be selectively moved from the angled recess, in a stowed configuration, to a deployed configuration in which the ends of the canard strip are outside of the angled recess, to act as canards.

According to yet another aspect of the invention, a method of operating a projectile includes: launching the projectile; after the launching, having the projectile perform a self test to validate proper projectile performance; and deploying canards of the projectile, wherein the deploying is initiated after the self-testing.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

A projectile has a fuze kit that includes deployable canards. The canards are ends of a strip of material. The strip of material is initially in an angled recess of a collar of the fuze kit, with the angled recess angled relative to a longitudinal axis of the projectile, defining a plane that is not perpendicular to the longitudinal axis. At some point in flight of the projectile, for example during mid-course of the projectile flight after a ballistic phase of the projectile flight, the canards are deployed by releasing the ends of the strip. This causes the ends of the strip to pull away from the longitudinal axis of the projectile, out of the recess, into the airstream around the projectile. Resilient forces in the strip may cause the ends to be moved out of the recess when the ends are released. This may be done as the strip regains (or approaches) an originally unstressed state, from which it was constricted to fit into the angled recess in a constrained (stowed) configuration prior to deployment. The ends of the strip act as canards, providing both lift and steering control to the projectile. Toward that purpose the canards (ends of the strip) may have different lengths from a center part of the strip that is attached to the collar. The different lengths of the canards allow the canards to essentially act as both wings (producing lift) and ailerons (producing roll).

Figure 1:
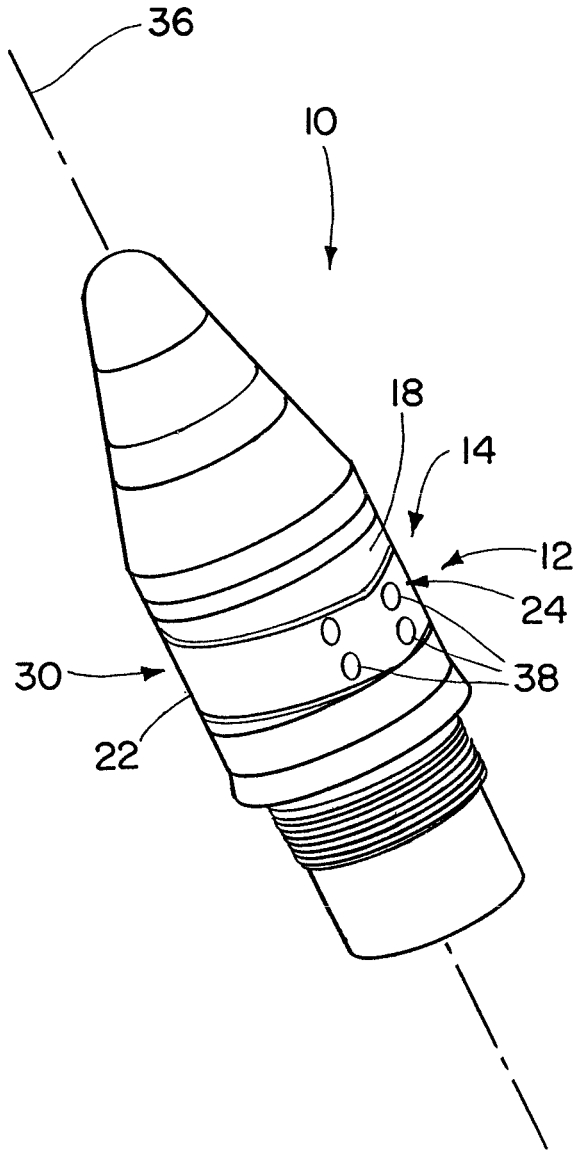
FIG. 1 is an oblique view of a fuze kit in accordance with an embodiment of the present invention.

FIG. 1 shows a fuze kit 10 that has a stowable canard strip 12 that is deployed during flight to produce canards that provide lift and roll. The strip 12 is stowed in a recess 14 in a collar 18 of the fuze kit 10. Ends 22 and 24 of the strip 12 may be released in flight to provide canards for the projectile that the fuze kit 10 is part of. A center part 26 of the strip 12 may be attached to collar 18, maintaining the connection between the strip 12 and the collar 18.

When the strip 12 is in its stowed configuration within the recess 14, the strip 12 may be maintained in a constrained condition. The constrained condition may involve the strip 12 being resiliently (elastically) bent inward, reducing the free (unconstrained) radius of the strip 12 in order to fit the strip 12 into the recess 14. The strip 12 may be held in place in the constrained stowed configuration by a securing mechanism 30 that keeps the ends 22 and 24 within the recess 14. The securing mechanism 30 may be released to allow deployment of the strip ends 22 and 24 as canards.

The strip ends 22 and 24 are initially in the stowed configuration, keeping the strip ends 22 and 24 out of the way during gun firing or other launch of the projectile. In addition it will be appreciated that the stowed configuration provides a lower drag in flight. In order to keep drag reduced the strip 12 may be maintained in a stowed condition during early stages of projectile flight, as will be discussed further below. For example the strip ends 22 and 24 may be kept stowed during an initially ballistic phase of flight, only being deployed during mid-course of flight, when course correction is desired.

The recess 14 is angled relative to a longitudinal axis 36 along a centerline of the fuze kit 10. The angle would be set to the size of the projectile to be controlled. To give a pair of examples, it is thought that 5 degrees for 105 mm and 10 degrees for 155 mm projectiles would be appropriate deflections. The angling of the recess 14 gives the deployed canards an angle of attack as the fuze-bearing projectile moves through the air. This allows the canards (the deployed strip ends 22 and 24) to provide a lift to rotate the projectile. The strip ends 22 and 24 may have different lengths, so as to provide different amounts of lift for the two strip end canards 22 and 24.

It will be appreciated that the projectile may be spin stabilized, or otherwise may be spun as part of its launch process, such as being spun as fired from a gun. It is known to use two-dimensional trajectory correction in projectiles spun at various rates. Examples of such correction methods may be found in co-owned U.S. Pat. No. 7,163,176, the specification and figures are incorporated herein by reference. Such a process may involve a bank-to-turn method of guidance. With bank-to-turn guidance it is possible to make both down-range and cross-range corrections.

It is also known that correcting trajectory of a spinning projectile may also include braking a portion of projectile that includes control surfaces. The braking may be used to selectively position the control surfaces, relative to an inertial frame of reference, in order to alter the trajectory of the projectile as desired, for instance for the projectile to reach a desired target. Examples of braking systems and roll damping systems used in trajectory control may be found in U.S. Pat. Nos. 7,354,017 and 7,412,930. It will be appreciated that the aileron function of the deployed strip ends (canards) may also be used to de-roll the collar 18.

The strip 12 may be a strip of spring sheet steel, although it will be appreciated that the strip 12 alternatively may be composed of any of a wide variety of other suitable materials. The strip 12 may be a single piece of material, which make for ease of manufacture and installation. Alternatively the strip 12 may be made of multiple pieces of material, for instance being made of two separate pieces, each attached to the collar at one end. The collar 18 may also be made of steel or another suitable material, with the recess 14 and other parts of the collar 18 perhaps formed by machining. The strip 12 may be attached to the collar 18 by spot welding, for instance with the strip center part 26 welded to the collar 18 at four weld locations 38.

The fuze kit 10 contains other common well-known elements that are not described further in detail. Such elements include a fuze for detonating a munition, such as an artillery shell, and a guidance system, for determining the location of the projectile and determining course corrections that will bring the projectile to a desired target location. The fuze kit 10 may have a threaded end or other suitable feature for coupling to other parts of the projectile.

Figure 2:
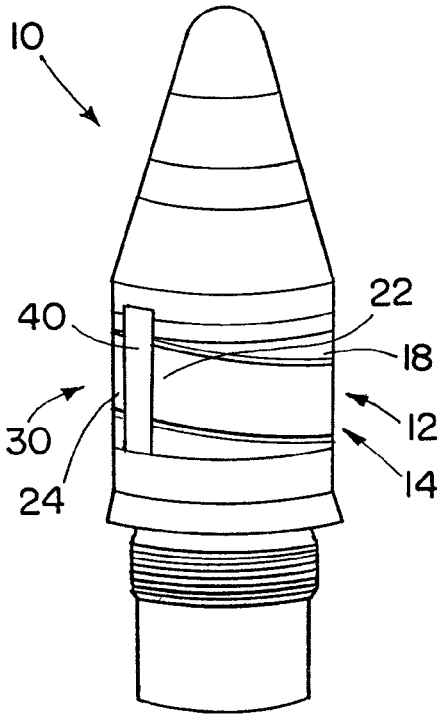
FIG. 2 is an oblique view of the fuze kit of FIG. 1, showing the securement mechanism of the fuze kit.
Figure 3:
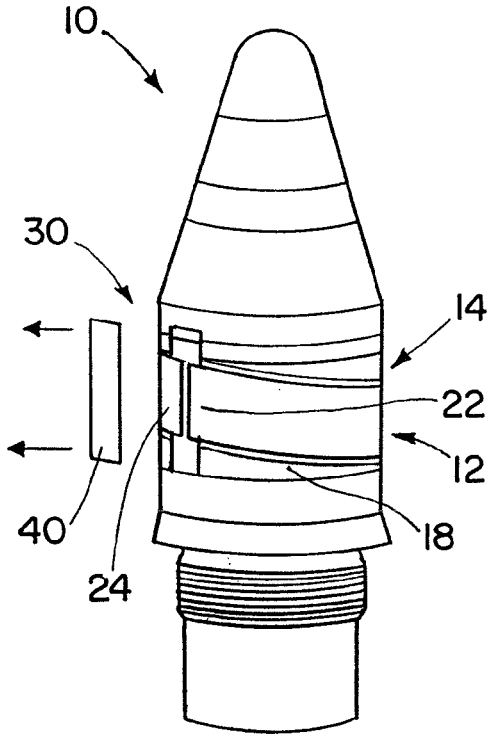
FIG. 3 is an oblique view showing an intermediate step in deployment of canards of the fuze kit of FIG. 2.
Figure 4:
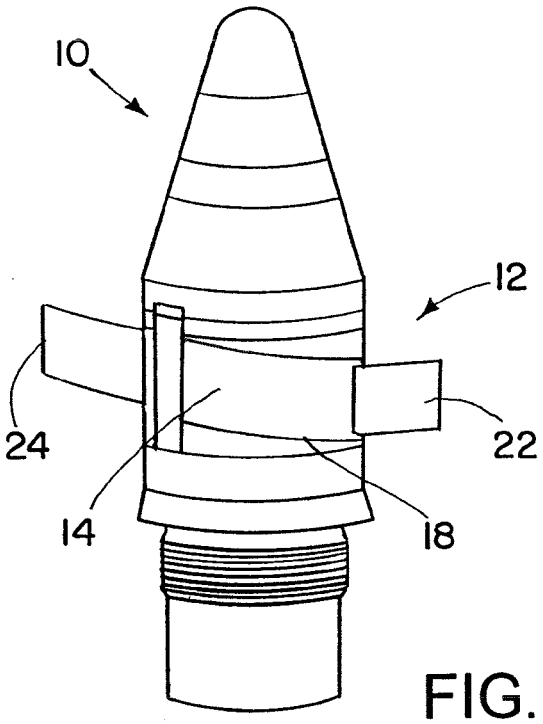
FIG. 4 is an oblique view showing the canards of the fuze kit of FIG. 2 fully deployed.
Figure 5:
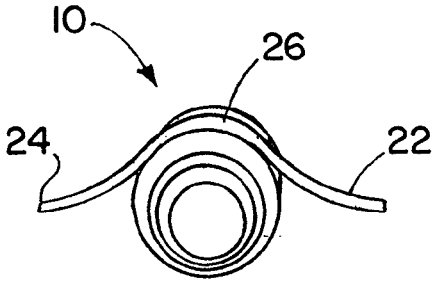
FIG. 5 is an end view of the fuze kit of FIG. 4.

FIGS. 2-5 show steps in the deployment of the strip ends 22 and 24 as canards. FIG. 2 shows the strip 12 in its stowed configuration, with the strip ends 22 and 24 secured within the recess 14 by a tab 40 of the securement mechanism 30. The tab 40 is a rectangular piece of metal which runs over the recess 14 and covers the distal parts of the strip ends 22 and 24, farthest from the strip center part 26. The tab 40 is configured to be released or jettisoned when deployment of the strip end canards 22 and 24 is desired, as shown in FIG. 3. This releases the constraining force on the strip ends 22 and 24, allowing the strip ends 22 and 24 to resiliently regain something of their shapes prior to be constrained to fit into the recess 14. This is shown in FIGS. 4 and 5. The deployed strip ends 22 and 24 may now function as canards 22 and 24, providing lift and roll forces to enable guidance of the projectile that includes the fuze kit 10.

Figure 6:
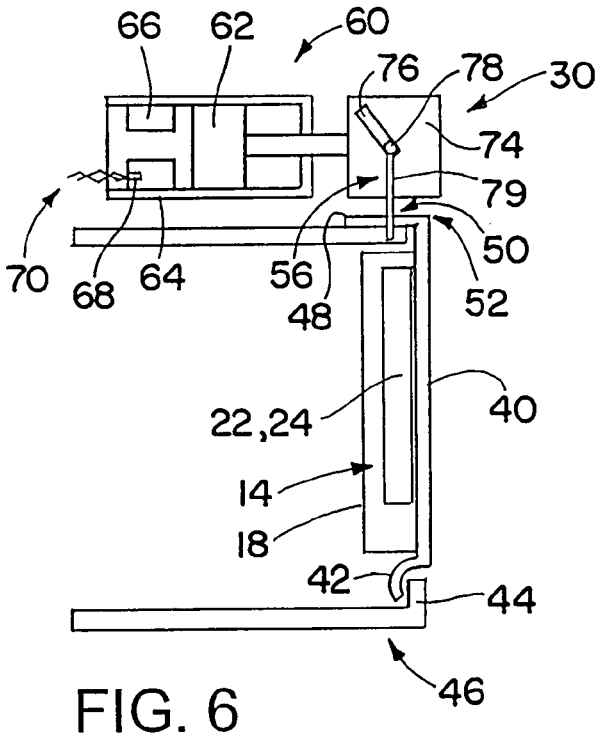
FIG. 6 is a schematic view of a securement mechanism of the fuze kit of FIG. 1, with the securement mechanism maintaining canards in a stowed configuration.

FIG. 6 shows further details regarding the securement mechanism 30. The tab 40 has a hook 42 at one end that engages the inside of a step or flange 44 of the fuze kit housing 46 below (off of one side of) the collar 18. On the other (opposite) side of the tab 40 is a folded-over flange 48 that has a hole 50 in it. The flange 48 is inserted into an opening 52 above (off to the other side of) the collar 18. A pin 56 is inserted into the hole 50, and retains the tab 40 coupled to the fuze kit housing 46.

The securement mechanism 30 includes a pin-retraction apparatus 60 for selectively retracting the pin 56. The pin-retraction apparatus 60 includes a piston 62 that is able to slide within a case 64. Also within the case 64 is an explosive material 66 that can be detonated by a squib 68, for instance by providing a electrical current through squib leads 70 that run from the squib 68 to an electrical power source outside of the case 64. The piston 62 is coupled to a block 74 such that as the piston slides within the case 64, the block 74 makes a corresponding translation. The block 74 has a slanted slot 76 within it that receives a portion 78 of the pin 56, with the portion 78 being angled (perhaps at a right angle) to the portion 79 of the pin 56 that engages the hole 50. The slot 76 acts a ramp as the block 74 moves due to a corresponding movement of the piston 62. Movement of the block 74 causes a perpendicular movement of the pin 56, through ramping action on the pin portion 78. The ramping action causes the pin 56 to be positioned either in or out of the hole 50. Thus the pin 56 selectively may be engaged or disengaged with the tab 40.

Figure 7:
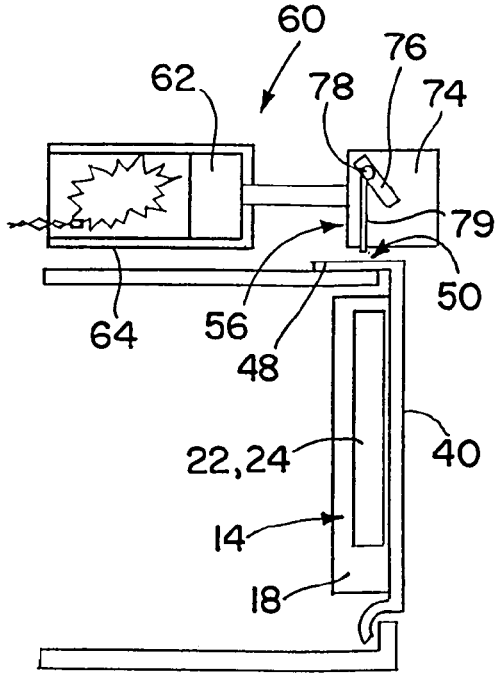
FIG. 7 is a schematic view of the securement mechanism of FIG. 6, showing a partially deployed configuration.
Figure 8:
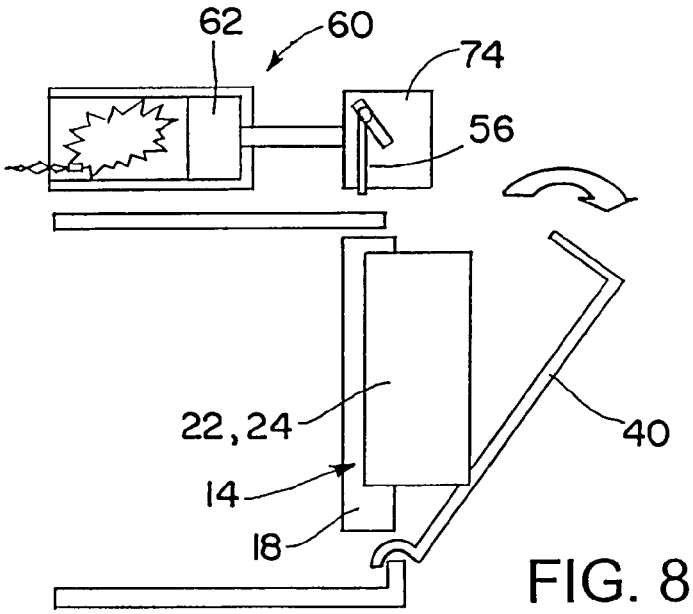
FIG. 8 is a schematic view of the securement mechanism of FIG. 6, showing another step in the deployment process.

With reference now in addition to FIGS. 7 and 8, the process of releasing the tab 40 is illustrated. From the secured (stowed) configuration of FIG. 6, current is provided through the squib leads 70 to detonate the squib 68, as shown in FIG. 7. This causes ignition of the explosive material 66. Pressurized gasses from the ignited explosive material 66 drive the piston 62 rightward to the opposite side of the case 64. This also moves the block 74 in the same direction (rightward in the figure). The movement of the block 74 causes the ramp surface of the slot 76 to bear against the pin portion 78. This pulls the pin 56 upward, out of the hole 50, disengaging the pin 56 from the tab 40.

Once the pin 56 is disengaged from the tab 40, the outward push by the strip ends 22 and 24 against the tab 40 pushes the tab 40 outward, as shown in FIG. 8. The tab 40 first rotates downward about the hook 42. Then the tab 40 separates fully from the fuze kit 10, with the strip ends 22 and 24 opening further to function as canards.

It will be appreciated that the securement mechanism 30 described above is only one of a wide variety of mechanisms for securing the strip ends 22 and 24 in the recess 14, while allowing selectable releasing of the strip ends 22 and 24 during flight of the projectile. Such other mechanisms may utilize a variety of mechanical fasteners and actuating mechanisms for accomplishing releasable securement of the strip ends 22 and 24. A simple rotation of apparatus 60 and integrating the pin 56 to piston 62 would allow a direct pin extraction without the block 74.

The securement mechanism 30 has the advantages of being reliable, inexpensive, and safe for handling by personnel. It will be appreciated that the amount of the explosive material 66 may be quite small, as the movement of the piston 62 and the block 74 only has to do the work of disengaging the pin 56. The small amount of explosive material 66 also may be of a low level of explosiveness, and therefore may be relatively save for handling. In addition accidental detonation of the explosive material 66, causing premature deployment of the canards 22 and 24, does not represent a significant hazard to nearby personnel. The jettisoned tab 40 is a lightweight part, and the resilient force of the strip ends 22 and 24 to return to a previous shape is minor.

The strip ends 22 and 24 advantageously do not require any external force for deployment as canards. No centrifugal forces are required, so successful deployment does not depend upon movement of the projectile. Nor are any mechanical mechanisms, such as springs, needed for deployment. However it will appreciated that alternatively mechanisms such as springs, hinges, or mechanisms requiring centrifugal force may be used. For example the canards each may have a double hinge configuration with a centrifugal lock. Another alternative is use of a smart metal such as a shape memory alloy for all or part of the strip 12. Heating or other energy may be applied to such a shape memory alloy to cause the alloy to return to a previous "memory" shape, for instance moving strip ends 22 and 24 out of the collar recess 14 for deployment as canards.

It will be appreciated that the control surface part of the fuze kit 10 may be easily assembled. First the strip 12 is cut. Then the strip 12 is wrapped around the collar 18, located in the recess 14. The center part 26 may be attached to the collar 18, such as by spot welding. The fuze kit 10 may then be placed into a suitable fixture to hold the strip ends 22 and 24 in place while the tab 40 is engaged (or while some other type of securement mechanism 30 is put in place for securing the strip ends 22 and 24).

Figure 9:
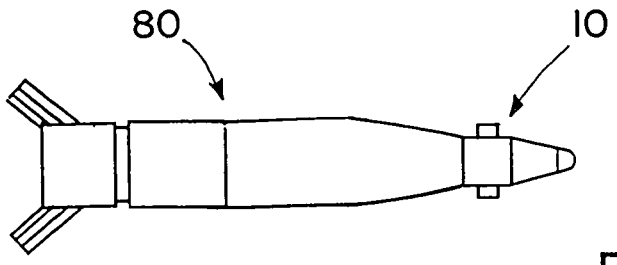
FIG. 9 is an oblique view showing the fuze kit of FIG. 1 as part of a first projectile.
Figure 10:
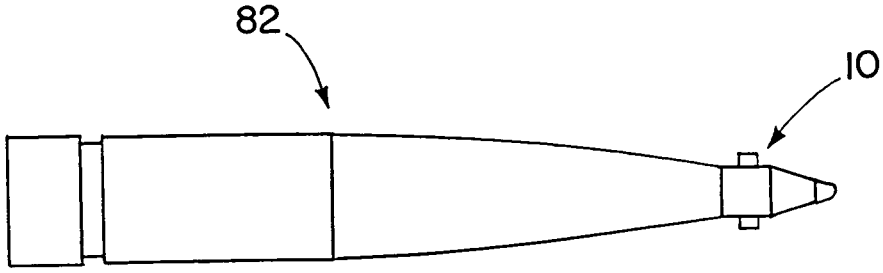
FIG. 10 is an oblique view showing the fuze kit of FIG. 1 as part of a second projectile.

The fuze kit 10 may be used with different sizes of projectiles, such as different sizes of artillery shells. FIG. 9 shows the fuze kit 10 used as part of a smaller projectile 80 (a 105 mm artillery shell in the illustrated embodiment). FIG. 10 shows the fuze kit 10 used as part of a larger projectile 82 (a 155 mm artillery shell in the illustrated embodiment). The illustrated embodiment in FIG. 9 is fin stabilized and the illustrated embodiment in FIG. 10 is spin stabilized, but it will also be appreciated that either size of projectile may be either spin stabilized or fin stabilized. It also will be appreciated that the fuze kit 10 may be used with a variety of sizes and types of aircraft, included both unpowered projectiles and powered missiles.

Figure 11:
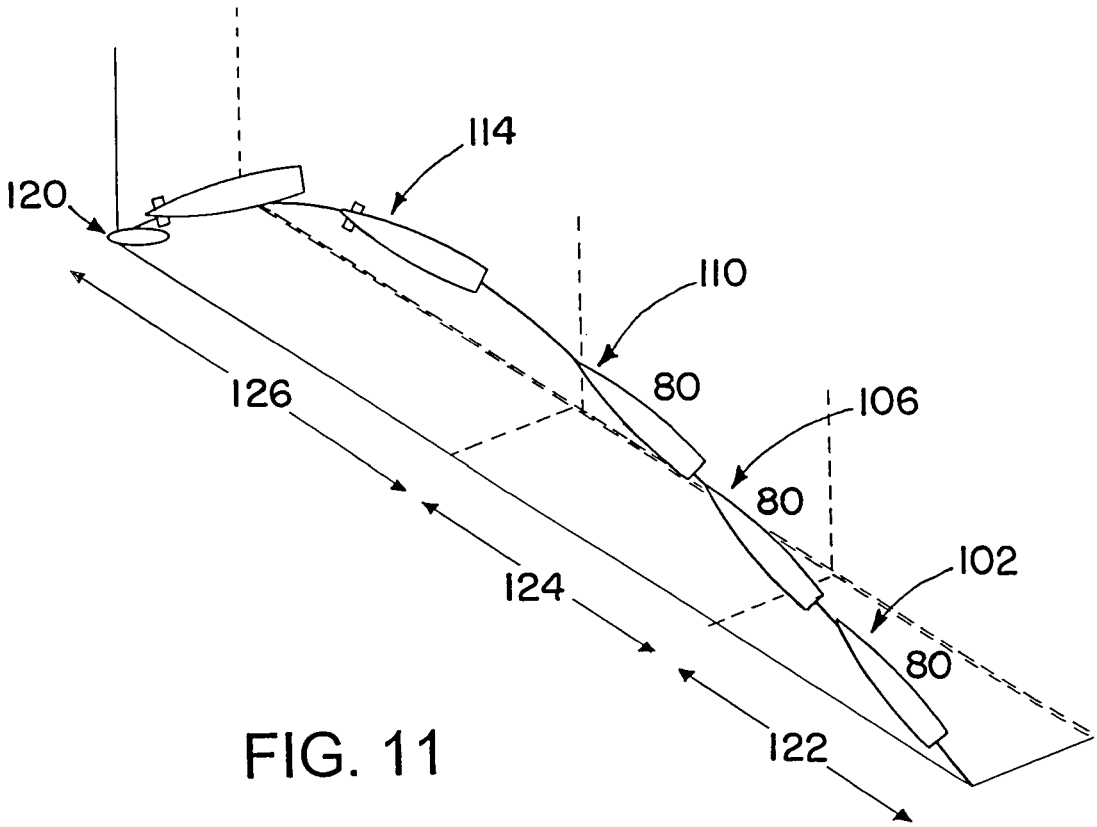
FIG. 11 is a view of an example flight path of a projectile that includes the fuze kit of FIG. 1.

FIG. 11 shows a flight 100 of the projectile 80, illustrating how the canards 22 and 24 may be deployed well into the flight of the projectile 80. The projectile launch is shown at 102. After the launch 102 the projectile 80 goes through a wake-up process at 106, when the power from batteries of the projectile 80 is used to power up systems of the projectile 80. The powering up of systems includes powering up a guidance system, for instance including a global positioning system (GPS) or other system for determining position of the projectile 80 during the flight 100, in order to provide information for guiding the projectile 80 on its course.

After the power-up process 106, the projectile 80 goes through a self-test depicted at 110. In the self-test process 110 the projectile 80 makes a determination whether it is capable of performing guided flight. If capable of performing guiding flight, the projectile 80 will be able to later deploy the canards, shown at 114, and guide itself to a desired target point 120.

The power-up process 106 and the self-test process 110 may be performed during an initial ballistic flight phase 122. The canard deployment 114 may be delayed until a mid-course flight phase 124, allowing guidance during remaining parts of the mid-course 124 and during a terminal phase 126 of the flight 100, when the projectile 80 approaches the target point 120.

It is desirable that the canard deployment 124 be done only when necessary for the guidance of the projectile 80. The canards add significant drag to the projectile 80, and it would be desirable to delay deployment of the canards until they are needed. Thus the canard deployment 114 may not occur immediately after the launch 102 or even right after the self-test process 110. The canard deployment 114 may be delayed until the mid-course phase 124, and even then may occur only when a decision is made by a guidance controller of the projectile 80 that the canards are needed for guidance. The decision can be time based, estimated miss based, suitable deployment dynamic pressure based, energy to target based, or a combination of the factors effecting the most suitable deployment time. The most likely parameters would be passing functional built-in test or BIT (a number of self-health test(s) which would result in canard deployment only if passed), GPS acquisition, and estimator convergence, but other appropriate factors may be used. This preserves the low-drag canards-stowed configuration of the projectile 80 until guidance is actually needed. This sort of delay of canard deployment is not possible for projectiles that have canards (or fins) deployed automatically upon launch, either by centrifugal forces or by other forces.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a collar having an angled recess that is angled relative to a longitudinal axis of the projectile; and a canard strip;

wherein ends of the canard strip may be selectively moved from the angled recess, in a stowed configuration, to a deployed configuration in which the ends of the canard strip are outside of the angled recess, to act as canards; and wherein the angled recess defines a plane that is not perpendicular to the longitudinal axis.

2. The projectile of claim 1, wherein the strip ends are resiliently bent inward to fit into the recess when the canard strip ends are within the recess; and wherein the strip ends resiliently unbend to move outside of the recess to deploy.

3. The projectile of claim 1, further comprising a selectively releasable securement mechanism that secures the canard strip ends in the recess when the strip ends are in the stowed configuration.

4. The projectile of claim 3, wherein the securement mechanism includes a releasable tab that runs over the recess and covers parts of the strip ends when the strip ends are in the stowed configuration.

5. The projectile of claim 1, wherein the canard strip is a steel strip.

6. The projectile of claim 1, wherein a central part of the canard strip, between the ends of the canard strip, is attached to collar, within the angled recess.

7. The projectile of claim 6, wherein the central part of the canard strip is spot welded to the collar.

8. The projectile of claim 6, wherein the ends of the canard strip have different lengths.

9. The projectile of claim 1, wherein the strip and the collar are parts of a fuze kit of the projectile.

10. The projectile of claim 1, wherein the projectile is an artillery shell.

11. A fuze kit comprising:

a collar having an angled recess that is angled relative to a longitudinal axis of the projectile; and a canard strip;

wherein ends of the canard strip may be selectively moved from the angled recess, in a stowed configuration, to a deployed configuration in which the ends of the canard strip are outside of the angled recess, to act as canards; and wherein the angled recess defines a plane that is not perpendicular to the longitudinal axis.

12. The fuze kit of claim 11, wherein the strip ends are resiliently bent inward to fit into the recess when the canard strip ends are within the recess; and wherein the strip ends resiliently unbend to move outside of the recess to deploy.

13. The fuze kit of claim 11, further comprising a selectively releasable securement mechanism that secures the canard strip ends in the recess when the strip ends are in the stowed configuration.

14. The fuze kit of claim 13, wherein the securement mechanism includes a releasable tab that runs over the recess and covers parts of the strip ends when the strip ends are in the stowed configuration.

15. A method of operating a projectile, the method comprising:

launching the projectile;

after the launching, having the projectile perform a self test to validate proper projectile performance; and deploying canards of the projectile, wherein the deploying is initiated after the self-testing;

wherein the deploying the canards includes releasing ends of a canard strip of the projectile, wherein the canard strip is angled relative to a longitudinal axis of the projectile, wherein the canard strip defines a plane that is not perpendicular to the longitudinal axis.

16. The method of claim 15, wherein the deploying occurs after a ballistic phase of flight of the projectile during which the self test occurs.

17. The method of claim 15, wherein, prior to the deploying the canards, a decision is made to deploy the canards based on whether course correction of the projectile is desired.

18. The method of claim 15, wherein the ends of the canard strip have different lengths.

19. The projectile of claim 1, wherein the collar is radially inward of the canard strip, when the canard strip is in the stowed configuration.

20. The projectile of claim 1, wherein, when the canard strip is in a deployed configuration, the canard ends are on opposite respective sides of the projectile.

21. The fuze kit of claim 11, wherein the collar is radially inward of the canard strip, when the canard strip is in the stowed configuration.

22. The fuze kit of claim 11, wherein, when the canard strip is in a deployed configuration, the canard ends are on opposite respective sides of the fuze kit.

* * * * *